US010611539B2

(12) United States Patent
Ludwig

(10) Patent No.: US 10,611,539 B2
(45) Date of Patent: Apr. 7, 2020

(54) CONTAINER PACKAGE

(71) Applicant: Christopher J. Ludwig, Buffalo Grove, IL (US)

(72) Inventor: Christopher J. Ludwig, Buffalo Grove, IL (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 390 days.

(21) Appl. No.: 15/049,920

(22) Filed: Feb. 22, 2016

(65) Prior Publication Data

US 2016/0257469 A1 Sep. 8, 2016

Related U.S. Application Data

(60) Provisional application No. 62/128,821, filed on Mar. 5, 2015.

(51) Int. Cl.
*B65D 71/50* (2006.01)

(52) U.S. Cl.
CPC ..... *B65D 71/50* (2013.01); *B65D 71/504* (2013.01)

(58) Field of Classification Search
CPC .... B65D 71/50; B65D 71/504; B65D 71/506; B65D 71/502
See application file for complete search history.

(56) References Cited

U.S. PATENT DOCUMENTS

| | | | | | |
|---|---|---|---|---|---|
| 2,415,598 | A * | 2/1947 | Mattson | B65D 71/50 | 294/87.28 |
| 2,431,713 | A * | 12/1947 | Stigler | B65D 71/0003 | 206/163 |
| 3,053,561 | A * | 9/1962 | Hamel | B65D 71/50 | 294/87.22 |
| 3,951,259 | A * | 4/1976 | Oglesbee | B65D 71/50 | 206/164 |
| 5,191,975 | A * | 3/1993 | Pezzoli | B65D 71/50 | 206/151 |
| 2009/0308763 | A1 * | 12/2009 | Oster | B65D 71/02 | 206/145 |

FOREIGN PATENT DOCUMENTS

| | | | | |
|---|---|---|---|---|
| BE | 1 013 086 A3 | | 9/2001 | |
| FR | 1 221 954 A | | 6/1960 | |
| FR | 1221954 A | * | 6/1960 | B65D 71/50 |
| FR | 2 195 218 A5 | | 3/1974 | |

* cited by examiner

*Primary Examiner* — Steven A. Reynolds
*Assistant Examiner* — Javier A Pagan
(74) *Attorney, Agent, or Firm* — Pauley Erickson & Kottis

(57) ABSTRACT

A package of containers within an array of corresponding container receiving apertures wherein a handle slides between a static position at least partially between the containers and a lifting position at least partially above the containers.

14 Claims, 4 Drawing Sheets

CONTAINER PACKAGE

CROSS-REFERENCE TO RELATED APPLICATION

This application claims priority to U.S. Provisional application Ser. No. 62/128,821, filed on 5 Mar. 2015. This U.S. Provisional application is hereby incorporated by reference herein in its entirety and are made a part hereof, including but not limited to those portions which specifically appear hereinafter.

BACKGROUND OF THE INVENTION

1. Field of the Invention

This invention relates to a container package that includes at least one flexible carrier and a handle forming a unitized package.

2. Description of Prior Art

Conventional container carriers are often used to unitize a plurality of similarly sized containers, such as cans, bottles, jars and boxes and/or similar containers that require unitization. Flexible plastic ring carriers are one such conventional container carrier.

Flexible plastic ring carriers having a plurality of container receiving apertures that each engage a corresponding container may be used to unitize groups of four, six, eight, twelve or other suitable groups of containers into a convenient multipackage. Flexible ring carriers may include a handle that extends upward fixedly and/or outward from the carrier to enable a consumer to carry the package.

Flexible ring carriers are typically fed across a rotating applicating drum having a plurality of jaws that open the individual container receiving apertures to stretch them around a respective container and then release them onto the container. In this manner, a package of multiple containers is formed.

SUMMARY OF THE INVENTION

In one embodiment, the present invention is directed to one or a pair of flexible carriers, an upper carrier and a lower carrier, for packaging containers. The carriers respectively engage at least one of an upper portion and a lower portion of a common plurality of containers to permit a tight, unitized package of containers.

According to preferred embodiments of this invention, a handle, preferably formed of a rigid material different from a flexible material of the carrier(s), is engaged between rows of containers to permit lifting and carrying of the package. The handle preferably resides below an upper edge of the containers when in a static position and slides upward when a user grasps the package in a lifting position. In this manner, the package is compact, shippable, displays well and consumes less space until the handle is grasped and the package is carried away by the consumer.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
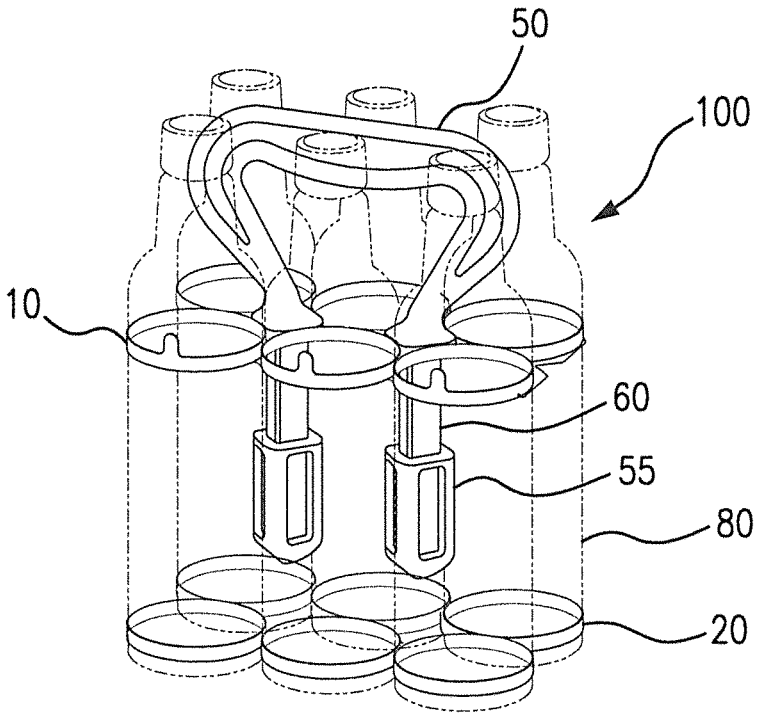
FIG. 1 is a side perspective view of a package having the handle in a static condition according to one preferred embodiment of this invention.

FIGS. 1-6 show a package 100 and a pair of flexible carriers 10, 20 for unitizing two or more containers 80 according to preferred embodiments. Although FIGS. 1-6 illustrate various structures for flexible carrier 10 of the invention, the illustrations are exemplary, and the invention is not limited to the flexible carriers 10 or packages of six containers shown in FIGS. 1, 2 and 5 and four containers shown in FIG. 6. For example, flexible carrier 10 may be alternatively configured and used to unitize eight, ten, fourteen or any other desired number of containers 80.

Containers 80, such as those shown in FIGS. 1, 2, 5 and 6 are preferably bottles, however, cans or any other commonly unitized container may be used with flexible carrier 10 according to this invention. The containers 80 are preferably, though not necessarily, like-sized within a single flexible carrier 10.

Each flexible carrier 10 preferably includes one or more layers of flexible sheet having a width and length defining therein a plurality of container receiving apertures 25, each for receiving a container 80. The plurality of container receiving apertures 25 are preferably arranged in longitudinal rows and longitudinal ranks so as to form an array of container receiving apertures 25, such as two rows by three ranks for a six container multipackage as shown in FIGS. 1 and 2.

As shown in FIGS. 1-4, the package 100 preferably includes an upper carrier 10 and a lower carrier 20. The upper carrier 10 preferably includes a plurality of apertures having a container removal feature, such as the tabs 15 shown in FIG. 3. In addition, the upper carrier 10 preferably includes at least two discrete retaining apertures 18, such as the diamond shaped apertures shown in FIG. 3. The lower carrier preferably includes a plurality of circular container apertures for relatively loose engagement of a lower portion of each container 80.

As described above, the plurality of container receiving apertures 25 are preferably arranged in an array. In this manner, an array of rows and ranks of containers 80 in the package 100 can cooperate with a corresponding array of other containers 80 in a stack of packages 100. According to a preferred embodiment of this invention, the upper carrier 10 is positioned along the top third of the container 80 and the lower carrier 20 is positioned toward a lower edge of the container 80.

Figure 2:
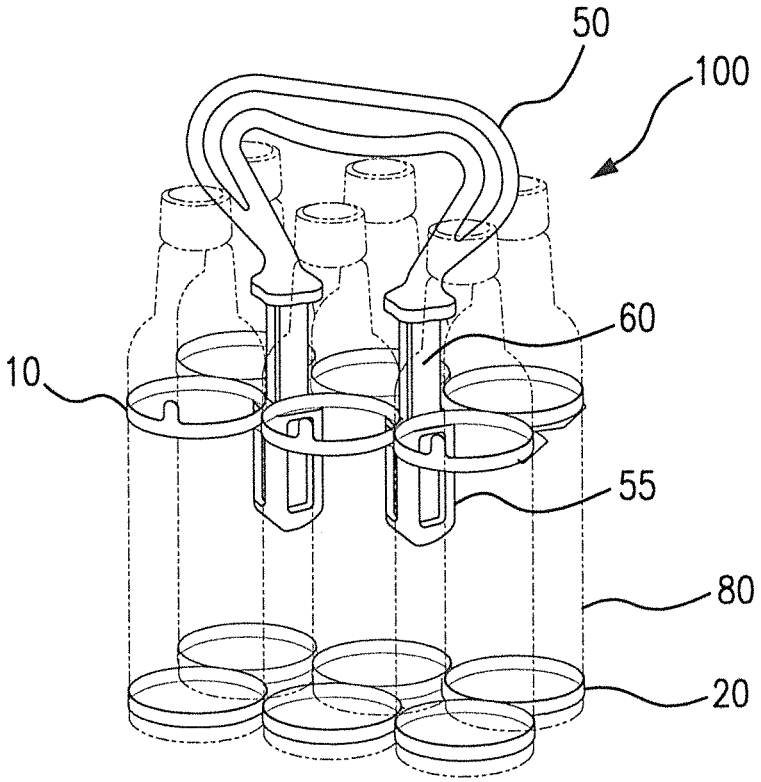
FIG. 2 is a side perspective view of the package shown in FIG. 1 with the handle in an extended position.

As shown in FIGS. 1 and 2, a handle 50 may comprise a separate structure that passes between the containers 80. In a preferred embodiment, the handle 50 engages with the retaining apertures 18 described above. The handle 50 may be a rigid, solid molded or similarly formed handle, constructed from a different material and having different physical properties from the carriers 10, 20. The handle 50 preferably comprises a horseshoe-like shape and includes two or more skewers or prongs 55 or similar features that engage within the retaining apertures 18 in the upper carrier 10 described above. Further, the handle 50 may include a waist or groove 60 within the prongs 55 that permit sliding within the upper carrier 10.

The handle 50 is preferably formed in a configuration that provides an ample area for a consumer to grasp by inserting his hand and still maintain the purpose and integrity of the package 100. The handle 50 in the described configuration preferably slides between a static position between the containers 80 and a lifting position raised above a top edge of the containers 80. FIG. 1 shows the handle 50 in the static position and FIG. 2 shows the handle 50 in the lifting position. In this manner, the handle 50 remains in the static position during manufacturing, shipping and shelf presentation and, when picked-up by the consumer in the lifting position, permits the consumer to avoid the container tops thus avoiding "knuckle-knock" or the scraping effects of container caps.

The handle includes a sliding stop 65 at each end of the waist 60 at each of the static position and the lifting position to delimit movement between the static position and the lifting position. In this manner, the lifting position of the handle 50 is higher than the static position by at least 25% of a container height to properly clear the top of the package 100 and the container tops.

Figure 3:
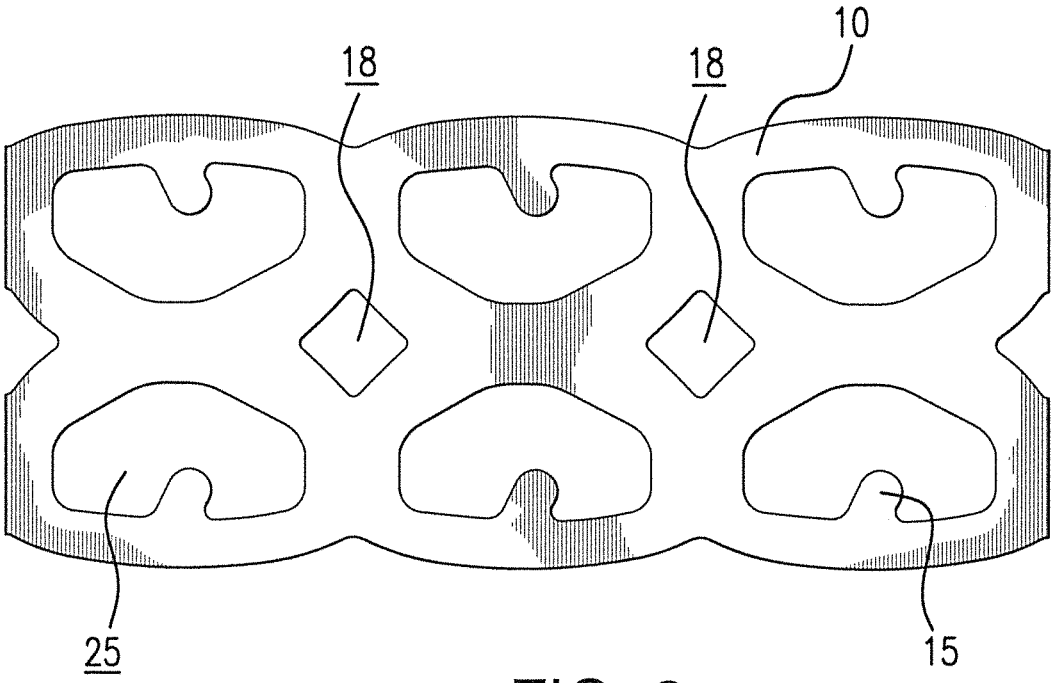
FIG. 3 is a side elevational view of an upper container carrier according to one preferred embodiment of this invention.
Figure 4:
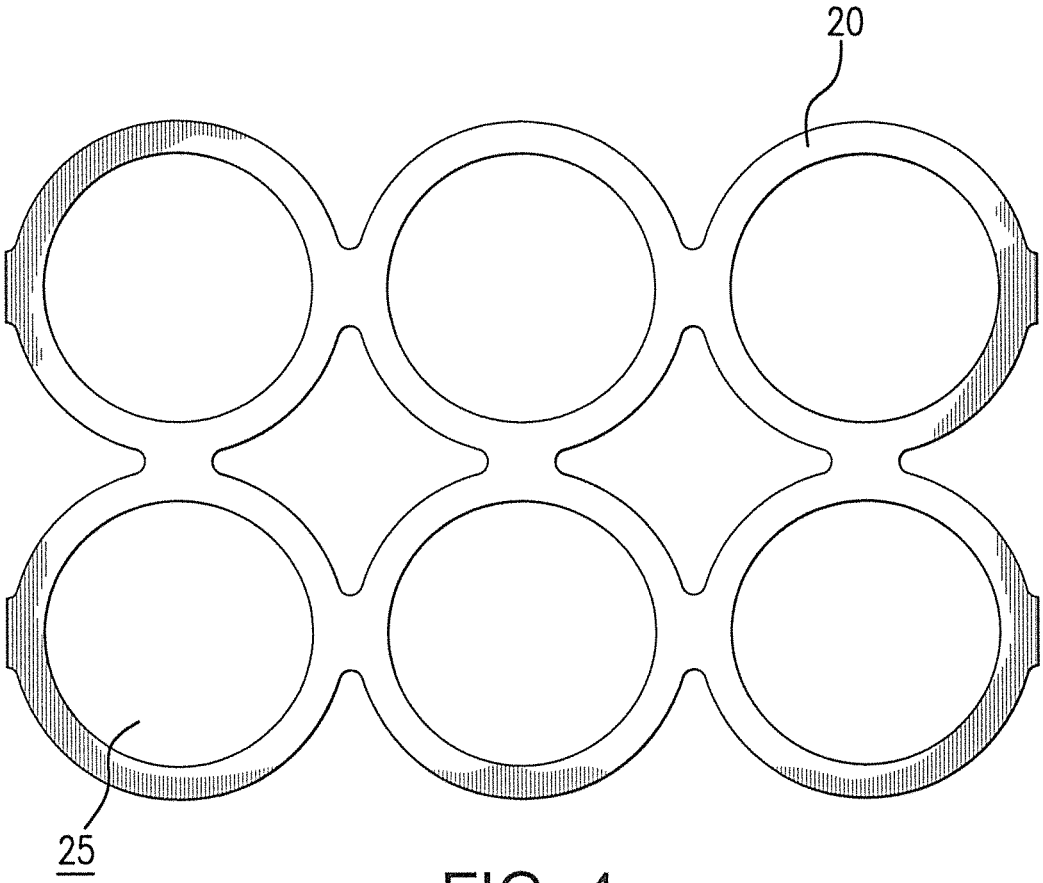
FIG. 4 is a side elevational view of a lower container carrier according to one preferred embodiment of this invention.

As shown in FIG. 3, the package 100 resulting from flexible carrier 10 includes a plurality of unitized containers 80. Upper carriers 10 and/or lower carriers 20 are generally applied to containers 80 by stretching the material surrounding container receiving apertures 25 around container 80, and requiring the stretched carrier 10 to recover, thereby providing a tight engagement. As described above, in one embodiment herein, the upper carriers 10 are stretched more than the lower carriers 20 during engagement. In the six pack variation shown in FIGS. 1 and 2, the handle 50 preferably extends for a length of the package 100. However, in the four package variation shown in FIG. 6, the handle 150 extends for greater than a length of the package 140. In eight container and larger formats, the handle 50 may not extend a full length of the package 100.

Figure 5:
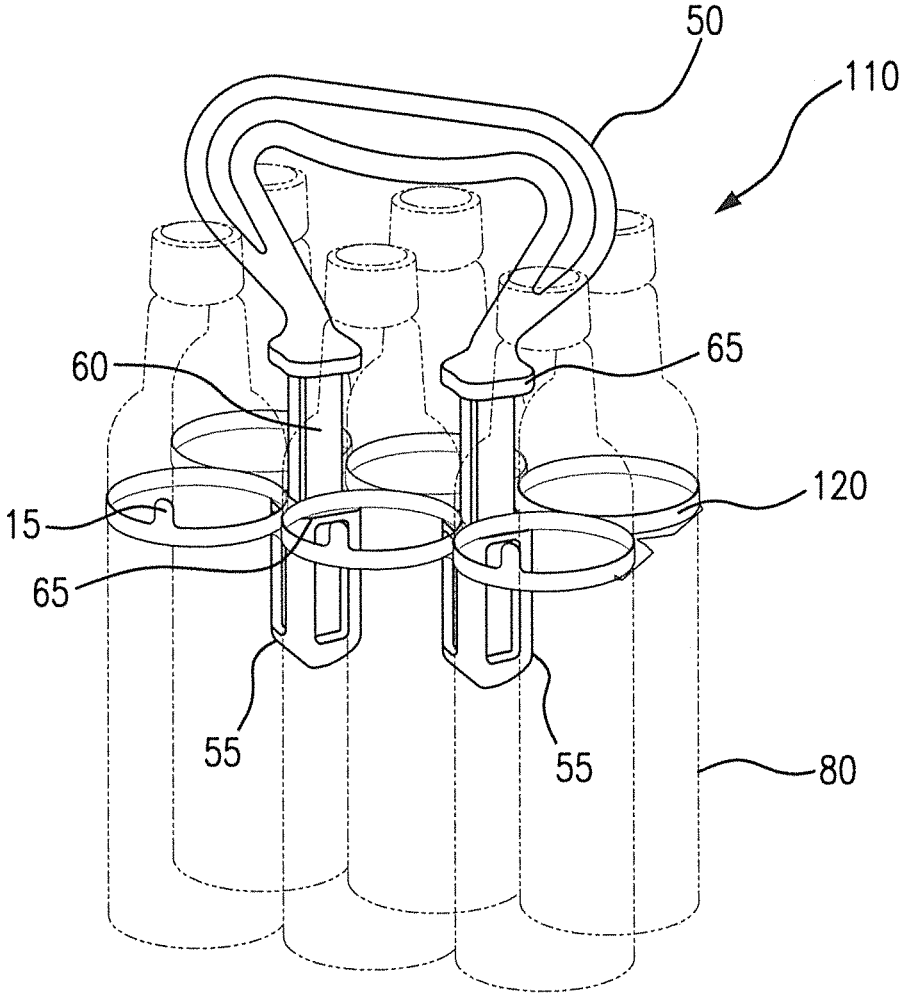
FIG. 5 is a side perspective view of a package with the handle in an extended position according to one preferred embodiment of this invention.

According to one preferred embodiment of a package 110, shown in FIG. 5, a single carrier 120 is used in connection with the handle 50. This package 110 operates in a similar fashion as the package 100 described above, however there is no lower carrier 20 positioned with respect to the containers 80.

Figure 6:
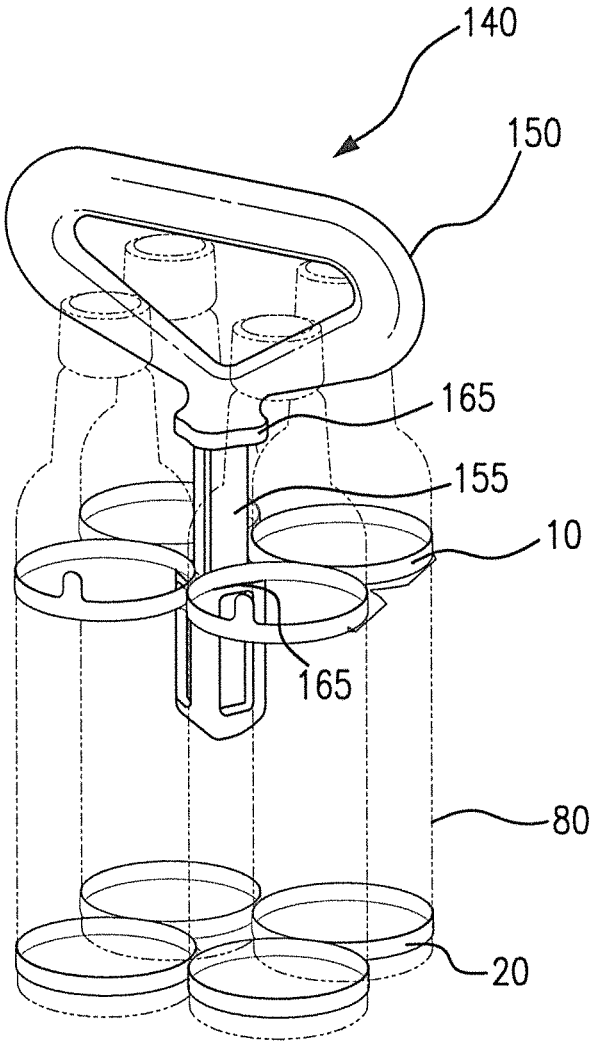
FIG. 6 is a side perspective view of a package with the handle in an extended position according to one preferred embodiment of this invention.

According to one preferred embodiment of a package 140, shown in FIG. 6, a handle 150 includes a single skewer or prong 155 that is centered within the package 140 having four containers 80. As in the embodiments described in FIGS. 1-5, the handle 150 preferably includes sliding stops 165 at each of the static position and the lifting position to delimit movement between the static position and the lifting position.

While in the foregoing specification this invention has been described in relation to certain preferred embodiments thereof, and many details have been set forth for purpose of illustration, it will be apparent to those skilled in the art that flexible carrier 10, 20, 120 and packages 100, 10 are susceptible to additional embodiments and that certain of the details described herein can be varied considerably without departing from the basic principles of the invention.

I claim:

1. A package of unitized containers comprising:

an upper carrier having an array of container receiving apertures that are stretchable around corresponding containers;

a plurality of containers, wherein each container receiving aperture is engaged with a corresponding container to form the package or unitized containers;

a handle having a prong that extends into a complementary retaining aperture within the upper carrier that is stretchable around the prone and wherein the handle slides between a static position at least partially between the containers and a lifting position raised at least partially above a top edge of the containers, and wherein the handle comprises a rigid non-flexible material and the upper carrier comprises a flexible material; and a waist positioned in the prong, the waist including a sliding stop at each of the static position and the lifting position to delimit movement between the static position and the lifting position of the handle.

2. The package of unitized containers of claim 1 wherein the handle comprises a rigid horseshoe shape.

3. The package of unitized containers of claim 1 wherein containers comprise bottles.

4. The package of unitized containers of claim 1 wherein the handle extends for approximately a length of the package.

5. The package of unitized containers of claim 1 wherein the handle consists of a single prong that extends into a complementary retaining aperture within the upper carrier.

6. A package of unitized containers comprising:

a flexible carrier having an array of container receiving apertures that are stretchable around corresponding containers;

a plurality of containers, wherein each container receiving aperture is engaged with a corresponding container to form the package of unitized containers; and a rigid handle engaged with the carrier, wherein the handle includes a pair of prongs that extend into complementary retaining apertures within the upper carrier that are stretchable around the prongs, wherein the rigid handle includes a prong that slides between a static position at least partially between the containers and a lifting position raised at least partially above a top edge of the containers, and wherein the handle comprises a rigid non-flexible material and the upper carrier comprises a flexible material.

7. The package of unitized containers of claim 6 further comprising a lower carrier engaging a lower portion of the containers.

8. The package of unitized containers of claim 6 wherein the lower carrier includes a different configuration than the flexible carrier.

9. The package of unitized containers of claim 6 wherein the rigid handle includes a sliding stop at each of the static position and the lifting position to delimit movement between the static position and the lifting position.

10. The package of unitized containers of claim 6 wherein the rigid handle includes a waist that permits sliding of the handle within the flexible carrier.

11. The package of unitized containers of claim 6 wherein the handle comprises a triangular shape.

12. The package of unitized containers of claim 6 Wherein the lifting position of the handle is higher than the static position by at least 25% of a container height.

13. A package of unitized containers comprising:

an upper carrier engaging an upper portion of the containers;

a lower carrier engaging a lower portion of the containers;

a plurality of containers, wherein each container receiving aperture is engaged by stretching the upper carrier into engagement with a corresponding container to form the package of unitized containers; and a handle engaged with the plurality of containers wherein the handle includes a waist portion that permits sliding of the handle within the plurality of containers, wherein the handle includes a pair of prongs that extend into complementary retaining apertures within the upper carrier that are stretchable around the prongs and wherein the handle comprises a rigid non-flexible material and the upper carrier comprises a flexible material.

14. The package of unitized containers of claim 13 wherein the lower carrier includes a different configuration than the upper carrier.

* * * * *